United States Patent [19]

Knaus et al.

[11] 4,372,533

[45] Feb. 8, 1983

[54] PNEUMATIC LIFT PAD

[75] Inventors: Ernest Knaus, Akron; Paul E. Liggett, Wooster; Raymond J. Namsick, Akron, all of Ohio

[73] Assignee: Goodyear Aerospace Corporation, Akron, Ohio

[21] Appl. No.: 357,365

[22] Filed: Mar. 12, 1982

Related U.S. Application Data

[63] Continuation of Ser. No. 151,049, May 19, 1980, abandoned.

[51] Int. Cl.[3] ..... B66F 3/24

[52] U.S. Cl. ..... 254/93 HP

[58] Field of Search ..... 156/133, 416; 251/231, 251/223; 137/354 R, 359; 92/92, 103 F; 72/63; 254/93 HP

[56] References Cited

U.S. PATENT DOCUMENTS

| | | | |
|---|---|---|---|
| Re. 24,272 | 2/1957 | Albee | 254/93 HP |
| 2,038,473 | 4/1936 | Bronson | 137/231 |
| 4,067,544 | 1/1978 | Vetter et al. | 254/93 HP |
| 4,072,550 | 2/1978 | Stalter | 156/133 |
| 4,210,475 | 7/1980 | Neubert et al. | 152/359 |

FOREIGN PATENT DOCUMENTS

| | | | |
|---|---|---|---|
| 2405788 | 8/1975 | Fed. Rep. of Germany | 254/93 HP |

*Primary Examiner*—Robert C. Watson

*Attorney, Agent, or Firm*—L. A. Germain; P. E. Milliken

[57] ABSTRACT

A pneumatic pad comprises reinforcement fabrics of parallel cords pre-formed to a specific radius through the edges of the pad and press-molded to a very flat pre-pressurized configuration. At least two orthogonally oriented reinforcement fabrics are embedded in elastomer and have lapped ends positioned in opposite covers of the pad such that each cover comprises at least three cord reinforcement plies two of which are oriented orthogonally with respect to the other.

15 Claims, 7 Drawing Figures

PNEUMATIC LIFT PAD

This is a Continuation of application Ser. No. 151,049 filed May 19, 1980 now abandoned.

BACKGROUND OF THE INVENTION

This invention generally relates to fluid pressure devices and more particularly to a flexible, elastomeric, cord-fabric reinforced, inflatable container that functions as an extremely powerful and efficient pneumatic lift pad or jack. The invention discloses a press molded pad structure which results in a very low profiled pre-inflation device that may be positioned in confined spaces and inflated to perform a powerful lifting function.

Pneumatic lift pads of the type alluded to are known and used in the art, there being various types and configurations available which attempt to meet the needs and requirements demanded of this type device. Exemplary of these are lift pads described and illustrated in U.S. Patents to Tezuka (U.S. Pat. No. 3,982,731); Orndorff, Jr. (U.S. Pat. No. 4,036,472); and Vetter (U.S. Pat. Nos. 4,067,544 and 4,143,854).

This invention provides an improvement in the state of the pneumatic lift pad art by the provision of a press-molded device that: exhibits a very low profile when in its non-inflated condition, provides a high burst strength and increased structural integrity for a greater safety factor when applied to vigorous lifting applications, is extremely abrasion, puncture, and cut resistant, and has a patterned exterior surface for aggressive non-slip stability. Further, the pneumatic pad of the present invention is characterized by a molded-in positioning locator in the cover ply that is of a contrasting color for ease in positioning of the pad in confined spaces.

BRIEF DESCRIPTION OF THE DRAWINGS

Various aspects and advantages of the invention will be better understood from a consideration of the following detailed description and accompanying drawings in the several figures in which like parts bear like reference numerals and in which.

DETAILED DESCRIPTION OF THE INVENTION

Figure 1:
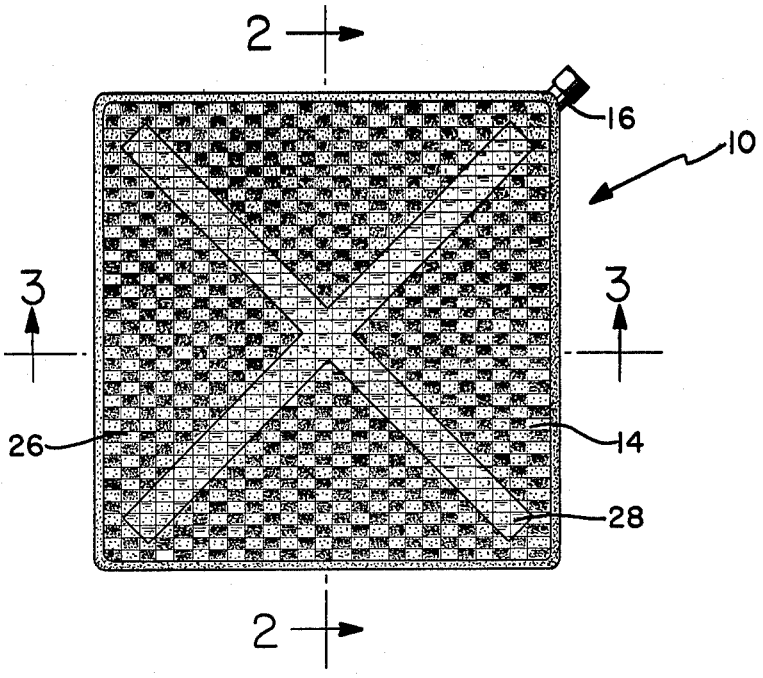
FIG. 1 is a plan view of the topside or the bottom side, both sides being identical, of the pneumatic lift pad comprising the invention.

Referring to the drawings, a pneumatic pad in accordance with this invention is generally indicated by reference numeral 10, which pad 10 is a multi-ply integrally laminated construction in a substantially square or rectangular configuration. While it will be recognized that other geometric shapes may be applied to the pad 10 and these are considered within the scope of the invention a square or rectangular shape is more conducive to the manufacturing process and therefore this description will be specifically directed to pneumatic pads of a square or rectangular configuration.

Figure 4:
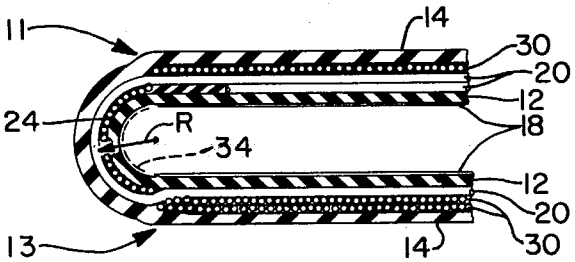
FIG. 4 is a partial elevational view, in section, of the structural components shown in FIG. 2 upon being press-molded and partially inflated.

With particular reference to FIGS. 2, 3, 4 and 5, the structural components comprising the pad are clearly illustrated. Basically the pad structure comprises an inner fluid (liquid or air) impervious liner or envelope 12, first and second cord fabric plies 20 and 30, an outer envelope 14, and a valve 16 (shown in FIGS. 1 and 6) for pressurizing the pad 10. The elements of liner 12, cord fabric plies 20 and 30 and outer envelope 14 are all common to two integrally laminated covers 11 and 13 as illustrated in FIG. 4.

Figure 6:
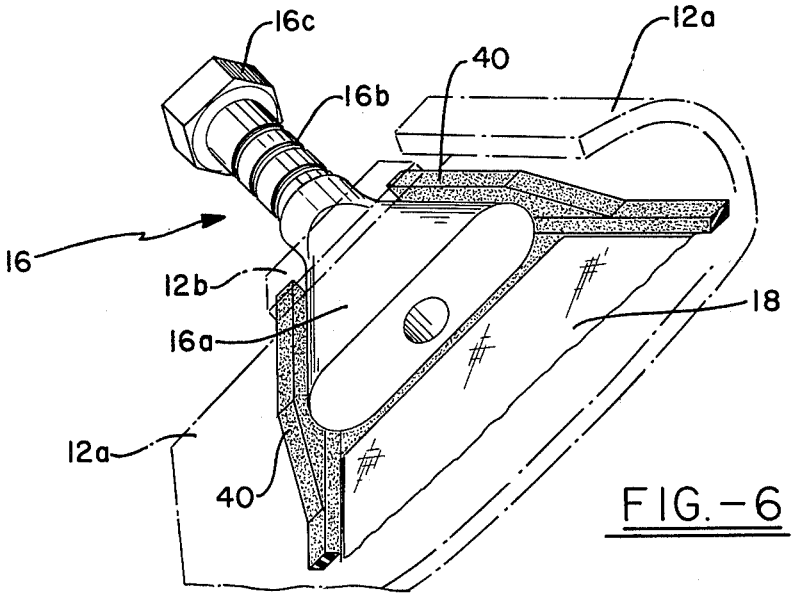
FIG. 6 is a perspective view, partially broken away and partially in section, illustrating the valve mounting within the structure of the pad.
Figure 2:
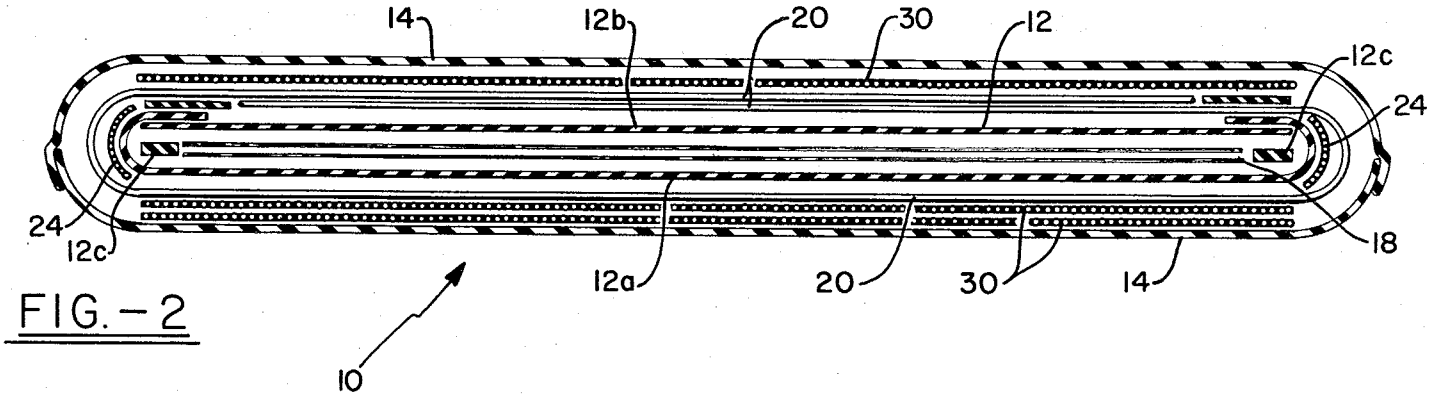
FIG. 2 is an elevational view, in section as may be taken on line 2—2 of FIG. 1, with the various plies separated for ease in illustrating the pre-cured ply orientation of the laminated pad structure.
Figure 3:
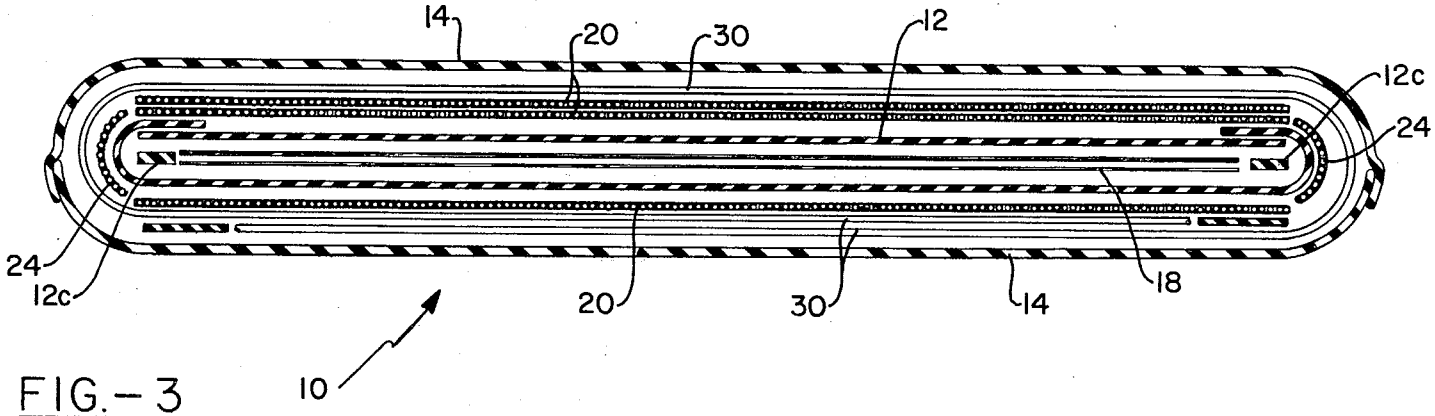
FIG. 3 is an elevational view similar to FIG. 2, in section and as may be taken on line 3—3 of FIG. 1, illustrating the pre-cured ply orientation of the structure.

The inner liner 12 is comprised of elastomeric ply sheets 12*a* and 12*b*, the sheet 12*b* being of a smaller dimension than the sheet 12*a* and thus providing a lap joint when the peripheral edges of the sheet 12*a* are folded over the sheet 12*b*. Because the pneumatic pad of this invention is a press-molded product, two sheets of a release paper 18 are inserted between the liner sheets 12*a* and 12*b* to maintain separation of the two upon vulcanization. Thus, upon being vulcanized, an enclosed envelope 12 is formed by the sheets 12*a* and 12*b*. Strips of gum elastomer 12*c* may also be provided and laid in along the periphery of the release paper 18 to maintain a uniform thickness of the liner 12 when a valve 16 is positioned in one of the corners as illustrated in FIGS. 1 and 6.

The cord fabric plies 20 and 30 are made similarily to a tire cord fabric and these may be of monofilaments or multifilament yarns of wire, synthetic or natural textiles, or glass embedded in a suitable elastomer to maintain a parallel orientation between adjacent cords. Steel wire, nylon, polyester, or aramid are the preferred cord materials because of the rigorous type application for these pads. The cord fabrics 20 and 30 are made in flat sheets to a specific length and width for a particular pad size and these sheets are folded in a press brake such as to impart a specific radius R to the cords prior to fabrication of the pad structure. For example the fabric may be folded such that a bend radius R of 4–20 mm is effected to the cords and the ends are overlapped to at least 75% of the length of fabric between the folds. A release liner is inserted to prevent sticking together of the overlapping fabric so that it may be stored for later use. The bend radius R will thus eliminate kinking of the cords throughout assembly, and cure operations. As illustrated, the cord fabric 20 comprises individual cords 22 folded such that it surrounds the innerliner 12, the ends of the cords 22 starting and ending a short distance in from the edge of the innerliner. In this configuration, the cord fabric 20 is single ply in one cover of the pad but it is double ply in the opposite cover. Similarly, the cord fabric 30 is folded such that individual cords 32 exhibit a radius R in the area of the fold and this fabric is applied about the cord fabric 20 such that the cords 32 are orthogonal to the cords 22. The cord fabric 30 however is applied oppositely to the cord fabric 20, that is, it is applied such that the lapped ends are positioned in the opposite cover than the lapped ends of the cord fabric 20. In this manner the cord fabric 30 provides a single ply in one cover where the cord fabric 20 is double ply and provides a double ply in the opposite cover where the cord fabric 20 is single ply. The orientation of the cord fabrics 20 and 30 combine to provide at least three plies of cord fabric in each of the covers 11 and 13 of the pneumatic pad 10. More simply stated there are two substantially complete plies of cord fabric 20 and one ply of cord fabric 30 in one cover of the pad while there are two substantially complete plies of cord fabric 30 and one ply of cord fabric 20 in the opposite cover of the pad and the cords 22 are oriented orthogonally to the cords 32.

While at least three cords fabric plies are in evidence in what would comprise the top cover 11 and bottom cover 13 of the pad 10, only a single ply of cord fabric would be provided in the edge walls of the pad. In this circumstance, cord fabric inserts 24 are positioned lengthwise along the lateral edges between the innerliner envelope 12 and the cord fabric plies 20 and 30. Thus, and because the cords 22 and 32 are oriented vertically in the edge areas of the pad, the cord fabric inserts 24 provide orthogonal and lateral reinforcement cords in the edges of the pad.

The outer envelope 14 comprises a cover ply sheet 14*a* and a cover ply sheet 14*b* which are lap joined about their peripheral edges. The outer envelope 14 is comprised of an elastomer such as neoprene that provides excellent weather and abrasion resistance and in addition is resistant to a wide range of chemicals. The envelope is further characterized by a texture illustrated in FIG. 1 that provides a very high friction surface. While there are many texture configurations that may be applied, applicants have found that a small basket-weave pattern 26 provides an excellent slip resistant friction surface to the pneumatic pad. This is of course important for the maintenance of the pad in its intended orientation in heavy lifting applications. Because the lift pad of this invention is a press-molded product, the texture may be imparted to the pad exterior covers by means of a suitable textured mold liner. Further, and to provide an aid in positioning of the pad, there is provided a high visibility locator embedded in each cover of the pad. FIG. 1 illustrates the use of an X-pattern locator 28 but others such as concentric circles or a bullseye pattern may also be applied. The locator pattern is preferably comprised of an elastomer in a high contrast color such as for example yellow or the like that is integrally vulcanized into the cover elastomer of the pad. It will be appreciated from the foregoing that the locator 28 is advantageous in placing of the pad in confined spaces.

Figure 7:
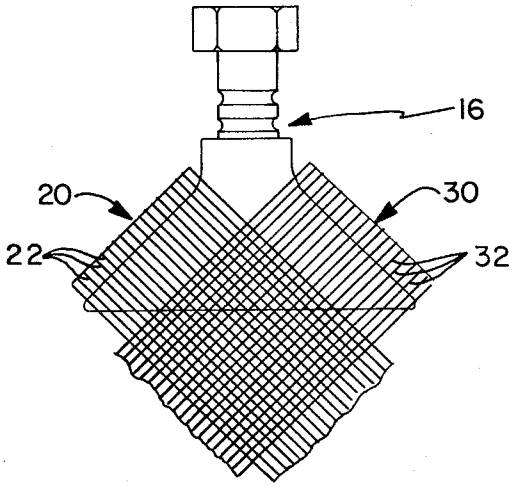
FIG. 7 is a diagramatic plan view of the corner valve mounting illustrated in FIG. 6 showing the reinforcement cord orientation relative to the valve.
Figure 5:
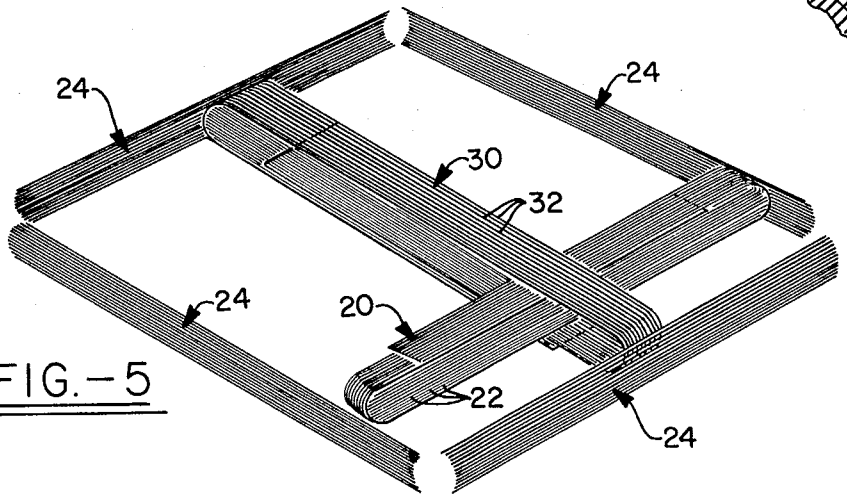
FIG. 5 diagramatically illustrates the arrangement of the reinforcement cord fabric plies.

FIGS. 6 and 7 illustrates the valve mounting within the pad structure and as shown the valve assembly 16 is a solid metal fitting of brass or the like having a tapered butt end 16*a* that is embedded in the corner elastomer of the pad structure. The valve comprises a substantially triangular shaped butt end 16*a* having a nipple end 16*b* that protrudes from the corner of the pad. Integral with the nipple is a hex 16*c* having internal threads that facilitate connection to a supply of high pressure air for inflation of the pad. The valve unit 16 is firmly seated with the base end 16*a* tapering to its larger extent toward the center of the pad and in this configuration may not be easily pulled out of the pad elastomer by reason of the crossed cords 22,32 as illustrated diagramatically in FIG. 7. In order to further embed the valve 16 in elastomer, wedge strips 40 may be positioned along either side of the butt end 16*a*. As indicated by the ghost line showing of the corner portion of the innerliner sheet 12*b* the valve 16 is positioned between the innerliner sheets 12*a* and 12*b* prior to vulcanization.

In addition to the structural components named above, applicants envision that in some applications additional cord fabric plies may be desired. In this circumstance, additional flat sheets may be applied to the covers 11 and 13 prior to application of the cover plies 14*a* and 14*b*. Further, and to provide increased strengthening of the innerliner 12, square woven fabric inserts 34 may be inserted laterally to cover the edge areas as illustrated by the dash-dotted line showing in FIG. 4. The purpose of the square woven cloth is to contain the liner elastomer 12 upon being inflated under high pressures and to limit splitting of the innerliner elastomer and possible loss of pad integrity by migration of the inflation fluid into the laminated structure.

Thus, it will be appreciated by those knowledgeable in the lift pad that applicants have provided an improved pad capable of handling various heavy lifting applications and while certain representative embodiments and details have been shown for the purpose of illustrating the invention, it will be apparent to those skilled in the art that various changes and modifications may be made therein without departing from the spirit or scope of the invention.

What is claimed is:

1. A press-molded, high-pressure, pneumatic lift pad including two substantially rectangularly-shaped, cord-reinforced, elastomeric covers enclosing an expansion chamber comprises:

a first reinforcement fabric comprised of a plurality of parallel cords, each of said cords being continuous from one cover through two opposite peripheral edges with the ends terminating in the opposite cover and overlapping at least 75% of the cover from one edge to the other;

a second reinforcement fabric comprised of a plurality of parallel cords, each of said cords being continuous from one cover through two opposite peripheral edges with the ends terminating in the opposite cover and overlapping at least 75% of the cover from one edge to the other, the cords of the second reinforcement fabric being orthogonally oriented with respect to the cords of the first reinforcement fabric and the lapped ends of each of the reinforcement fabrics being embedded in elastomer of the opposite cover such that each cover is comprised of at least three reinforcement cord plies and the cords of two of the plies are oriented orthogonally with respect to the other of the plies;

at least one ply of reinforcement fabric comprised of a plurality of parallel cords embedded in elastomer and positioned laterally in the peripheral edges of the pad so as to be orthogonal to the cords of the first and second reinforcements which pass through the peripheral edges;

at least one ply of a square woven fabric embedded in the peripheral edges of the pad inwardly of the other reinforcement cord fabrics;

a ply of a release material adhered to the inside surface of at least one of the covers; and a valve mounted in at least one of the corners of the pad and having a nipple portion protruding from the corner thereof for connection to a source of high pressure fluid, said nipple terminating in a substantially flat, triangular-shaped base embedded in elastomer and the taper of the base is substantially parallel to the edges of the pad such that the cords of the reinforcement fabrics form crossed-cords which entrap the triangular base within the pad structure.

2. The pneumatic pad as set forth in claim 1 wherein the cords of the reinforcement fabric are comprised of steel.

3. The pneumatic pad as set forth in claim 1 wherein the cords of the reinforcement fabric comprise synthetic yarns.

4. The pneumatic pad as set forth in claim 1 wherein the cords of the reinforcement fabric comprise synthetic monofilaments.

5. The pneumatic pad as set forth in either of claim 3 or claim 4 wherein the cords comprise nylon.

6. The pneumatic pad as set forth in either claim 3 or claim 4 wherein the cords comprise polyester.

7. The pneumatic pad as set forth in either claim 3 or claim 4 wherein the cords comprise aramid.

8. The pneumatic pad as set forth in claim 2 wherein the cords of the reinforcement fabrics exhibit a difinite bend radius in the area of the pad edge.

9. The pneumatic pad as set forth in claim 8 wherein the radii of the cords at the fold are at least 4 mm.

10. The pneumatic pad as set forth in claim 9 wherein the radii are within the range of 4–20 mm.

11. The pneumatic pad as set forth in claim 10 wherein the radii are 6 mm.

12. The pneumatic pad as set forth in claim 1 wherein the covers are patterned with a basket-weave high-friction exterior surface texture.

13. The pneumatic pad as set forth in claim 1 wherein a high visibility pattern of a contrasting color elastomer is embedded in the cover elastomer to provide a locator for the pad center.

14. The pneumatic pad as set forth in claim 13 wherein the pattern comprises an X-pattern, the center of which coincides with the center of the pad.

15. The pneumatic pad as set forth in claim 13 wherein the pattern comprises a circular pattern the center of which coincides with the center of the pad.

* * * * *